US012539896B2

(12) United States Patent
Thoni

(10) Patent No.: US 12,539,896 B2
(45) Date of Patent: Feb. 3, 2026

(54) BOGIE FRAME FOR RAIL VEHICLES MADE FROM AN ALUMINUM CASTING

(71) Applicant: Lothar Thoni, Jakobsbad (CH)

(72) Inventor: Lothar Thoni, Jakobsbad (CH)

( * ) Notice: Subject to any disclaimer, the term of this patent is extended or adjusted under 35 U.S.C. 154(b) by 149 days.

(21) Appl. No.: 18/203,466

(22) Filed: May 30, 2023

(65) Prior Publication Data

US 2024/0059329 A1 Feb. 22, 2024

Related U.S. Application Data

(62) Division of application No. 16/955,680, filed as application No. PCT/EP2018/085223 on Dec. 17, 2018, now Pat. No. 11,702,118.

(51) Int. Cl.
*B61F 5/52* (2006.01)
*B22C 9/02* (2006.01)
*B22D 25/02* (2006.01)

(52) U.S. Cl.
CPC ..... *B61F 5/52* (2013.01); *B22C 9/02* (2013.01); *B22D 25/02* (2013.01)

(58) Field of Classification Search
CPC ..... B61F 5/52; B61F 5/50; B61F 3/02; B22D 25/02; B22C 9/02
See application file for complete search history.

(56) References Cited

U.S. PATENT DOCUMENTS 3,338,183 A 8/1967 Boissier
3,547,046 A 12/1970 Lich
4,258,629 A 3/1981 Jackson et al.
4,620,582 A * 11/1986 Muller-Spath ..... B22C 9/068 164/24
5,653,177 A 8/1997 Rimbaud et al.
6,220,177 B1 4/2001 Landrot
8,925,466 B2 * 1/2015 Reese ..... B61F 5/06 105/182.1
9,216,450 B2 * 12/2015 Gotlund ..... B22C 9/22
(Continued)

FOREIGN PATENT DOCUMENTS

AU 2005248978 A1 2/2006
CN 106004915 A 10/2016
(Continued)

OTHER PUBLICATIONS

International Search Report and Written Opinion for corresponding International Application No. PCT/EP2018/085223, dated Apr. 2, 2019, 15 pages.

*Primary Examiner* — Cheng Lin
(74) *Attorney, Agent, or Firm* — DITTHAVONG, STEINER & MLOTKOWSKI

(57) ABSTRACT

The invention relates to a bogie frame (1) for rail vehicles having at least two wheelsets, the bogie frame comprising two longitudinal members (3), which extend parallel to each other above the axle bearings, one or more cross-members (2) connected to the longitudinal members (3), and a receiving region (5) for functional elements, the bogie frame (1) being produced completely as a single casting of an aluminum alloy in a sand casting process, said casting having a hollow profile, which has cavities (10) in the interior and is stabilized by means of ribbings (8, 9).
The invention further relates to a method for producing a bogie frame of this type and to a rail vehicle equipped with a bogie frame of this type.

3 Claims, 4 Drawing Sheets

(56) References Cited

U.S. PATENT DOCUMENTS

Figure 1:
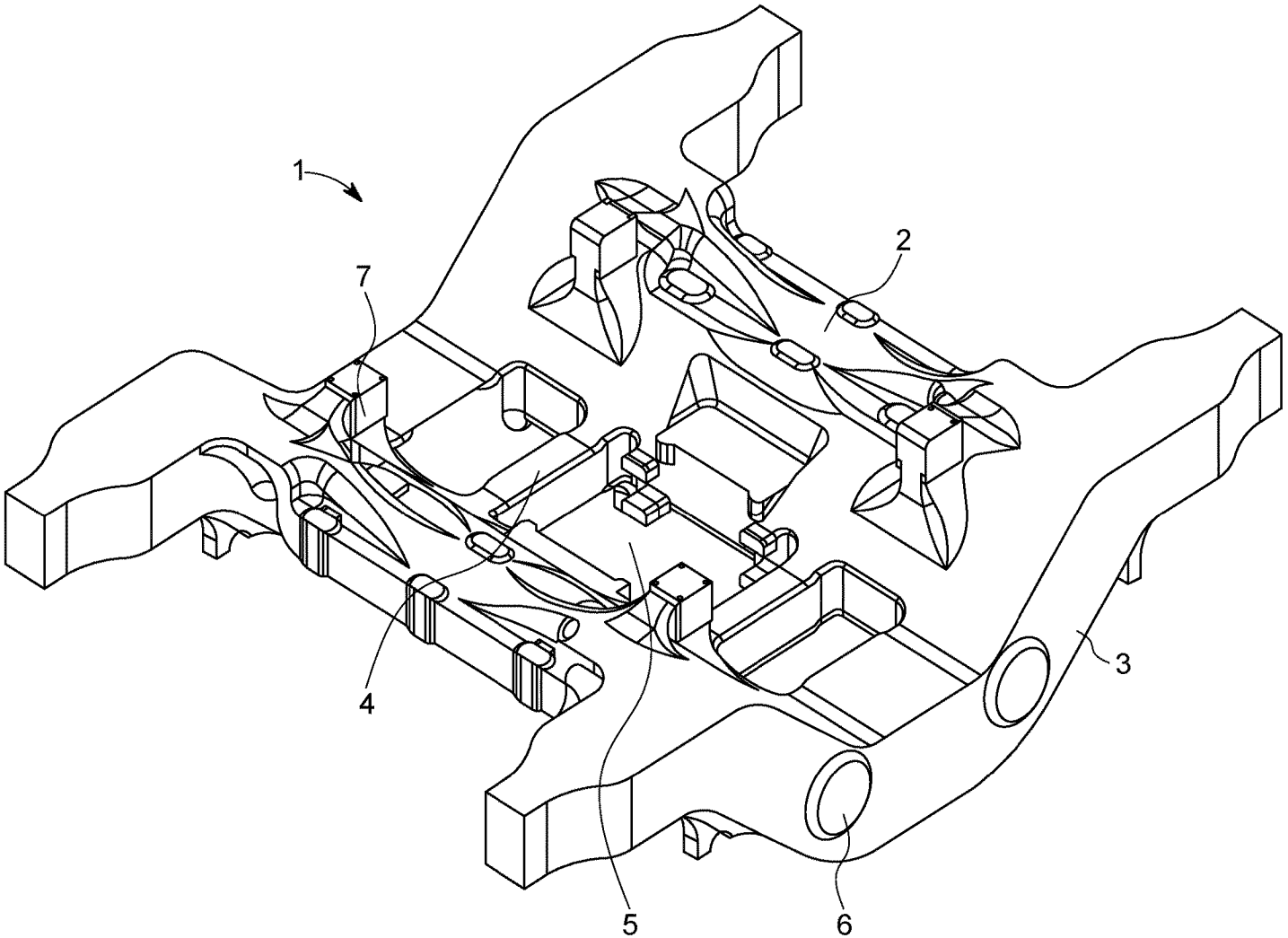

| | | | | |
|---|---|---|---|---|
| 10,532,752 | B2 * | 1/2020 | Hubmann | B61F 1/08 |
| 10,625,755 | B2 * | 4/2020 | Thoni | B61F 1/12 |
| 2007/0227689 | A1 * | 10/2007 | Green | C23C 24/08 164/72 |
| 2017/0232503 | A1 * | 8/2017 | Nibouar | B22C 1/00 164/138 |

FOREIGN PATENT DOCUMENTS

| | | | | |
|---|---|---|---|---|
| DE | 19819412 | C1 | 10/1999 | |
| EP | 1150872 | B1 | 3/2004 | |
| EP | 1637425 | A2 | 3/2006 | |
| EP | 2165913 | B1 | 7/2012 | |
| EP | 2669138 | A1 | 12/2013 | |
| JP | 2010149808 | A * | 7/2010 | B61F 5/10 |
| KR | 20160048264 | A * | 5/2016 | |
| WO | 2019/121524 | A1 | 6/2019 | |

* cited by examiner

BOGIE FRAME FOR RAIL VEHICLES MADE FROM AN ALUMINUM CASTING

This application is a Divisional of U.S. application Ser. No. 16/955,680, filed Jun. 18, 2020, which claims priority to PCT Application No. PCT/EP2018/085223, filed Dec. 17, 2018, which claims priority to German Patent Application No. 202017107670.9, filed Dec. 18, 2017, the contents of each are hereby incorporated herein in their entirety by this reference.

TECHNICAL FIELD

The present invention relates to a bogie frame for rail vehicles with at least two wheelsets according to the preamble of claim 1.

BACKGROUND ART

The running gear of a rail vehicle consists of a bogie in which wheelsets are mounted in a frame that can rotate relative to the carriage body. Bogies are built in various types and designs. A very old bogie is the gooseneck bogie or bogies from Görlitz and Minden-Deutz. The chassis of a bogie must have a high bearing load capacity and consists of at least one cross-member on which the pivot joint of the body of the carriage rests. Two longitudinal members arranged parallel to each other are attached to the ends of the cross-member. The longitudinal members are connected to the four wheels of the bogie by means of suspension. The suspensions consist of different spring assemblies which are mounted coaxially. Today, said suspension systems usually consist of a secondary suspension and a primary suspension. Bogies of this sort are described for example in EP 1 150 872 B1, EP 1 637 425 A2, U.S. Pat. No. 4,258,629 A, DE 198 19 412 C1 or EP 2 165 913 B1.

In the classic version, larger rail vehicles are equipped with two bogies, each having two wheelsets. However, designs are also known in which a variable number of axles and wheels per bogie can be used, depending on the structure of the rail vehicle. This way, the number of wheelsets can be adapted to the desired and permitted load capacity of a wagon.

All other parts such as wheelsets, suspensions and dampers are attached to a bogie frame. In most cases the bogie frame consists of a welded steel construction, sometimes the frame is made of cast steel.

The bogie further includes a pivot pin, also called bogie socket, which connects the bogie to the carriage body and usually transmits the longitudinal forces between the carriage body and the bogie. The bogie moves around the vertical axis formed by the pivot pin.

Previously known bogie frames are extremely heavy, have a high residual stress and, if made of steel, are subject to corrosion. Welded constructions made of sheet steel and steel tubes require a complex and therefore cost-intensive production process. Furthermore, welded bogie frames also have welded seams which are exposed to stresses and can crack under heavy stress. Said welded seams on steel structures are particularly susceptible to mechanical stress in highly stressed components, such as a bogie frame, which ultimately reduces the mechanical load capacity of the components.

Moreover, the bogie frames known up to now cause loud driving noises, which can only be reduced by extensive damping measures.

DISCLOSURE OF INVENTION

Therefore, in order to avoid said disadvantages, it is the object of the present invention to provide a bogie frame for rail vehicles with at least two wheelsets, which is reduced in weight compared to a steel construction and which has significantly reduced driving noises. Preferably, the weight is reduced by about 40% compared to a steel construction. The reduction in weight depends on the respective embodiment.

This object is solved by a bogie frame with the features of claim 1 and a method for producing a bogie frame of this type. Preferred embodiments can be found in the subordinate claims.

The bogie frame for rail vehicles according to the invention with at least two wheelsets consists of two longitudinal members running parallel to each other above the axle bearings, which are connected to each other by one or more cross-members. In one variant, the longitudinal members and the cross members can be joined by means of bolted or welded connections, depending on the function. Inside the bogie frame there is a receiving region for connecting the pivot pin and other functional elements. According to the invention, it is intended that the bogie frame is produced completely as a casting of an aluminum alloy, preferably by sand-casting. With this method, cavities or hollow profiles can be produced which are stabilized by means of ribbings.

Preferably, the bogie frame according to the invention is produced using the aluminum sand-casting method. The mold is preferably produced after preparing a model by hand molding or by core block molding. It is a "lost mold", as the mold and the cores made of chemically bonded or clay-bonded sand have to be destroyed after casting.

Typical functional elements in bogies of rail vehicles are elements for the safe running of the rail vehicle on the track system. Besides the bogie frame, these include primary and secondary suspensions, dampers, brake systems, wheelsets, and, depending on the embodiment, also engines and transmissions.

The invention relates to a bogie frame as a single, complete casting made of an aluminum alloy, which accommodates the functional elements and their transmitting of forces and loads, and which guarantees safe operation. Thus, the bogie frame is available as a single casting, which is intended to replace the previously known steel structures for rail vehicle bogies. Complex welding work and welded seams susceptible to tensile stress are thus avoided. Furthermore, by producing the bogie frame in one piece from an aluminum alloy, costs are reduced by approximately 30 to 50%. This is a considerable advantage over known bogie frames made of steel. The inspection interval in continuous operation for testing the component for stress cracks can be adjusted and increased according to the calculation results, the dynamic fatigue test and the current inspection results.

The technical parameters of the bogie frame produced by the sand-casting method are optimally adapted to the mechanical stress and the requirements of continuous operation. Preferably, the cavities of the bogie frame are produced by help of sand cores made of chemically bonded sands, said sand cores being stored in the mold. Due to the heat-treatment in T6 which takes place during the production process, the casting is almost stress-free. Residual stresses can be neglected because of the heat-treatment during the production process. Due to the structure and the mechanical properties of the aluminum alloy, a weight reduction of about 40% can be achieved.

The required stability is provided by the cavities formed inside the casting and by the ribbing provided within said cavities.

Preferably, the cavities of the two longitudinal members and/or the cross members can be used as air reserve reservoirs for the functional elements of the rail vehicle. Said reservoirs provide a considerable advantage over the air reserve reservoirs of known bogie frames, such as for the cross-members or air reservoirs welded from sheet steel especially for this purpose. The cavities of the bogie frame can be used to create air reserve reservoirs which can take over said function completely. This means that complex constructions using cross-members or other forms of air reservoirs are no longer necessary. Obviously, it must be ensured that the cavities of the bogie frame provided for said purpose are produced airtight and are tested according to the technical specifications.

Furthermore, in a preferred embodiment, ribs are provided in high-wear areas on the underside in order to prevent stone chipping. Said high-wear areas must be protected against stone chipping because they are located on the underside of the bogie frame and must each protect against loose gravel that is sucked up in the direction of travel. The ribs are placed at a distance of at least 20 mm from each other and they are at least 5 mm thick.

In a preferred embodiment, it is intended that a rubber coating is applied between the ribs, preferably by spraying a layer of at least 5 mm. By applying the rubber coating, steel plates bolted to the underside of the trains are not necessary anymore, which results in further considerable cost and benefit advantages of the bogie frame according to the invention.

The preferred aluminum alloy is an alloy of aluminum, silicon and magnesium. Optionally, manganese, copper or zinc can also be added, if the surfaces are not affected by corrosion and are protected with elastic wet paint. Preferably, however, copper and zinc contents should be kept low to prevent corrosion. The aluminum alloy according to the invention enables a casting with high mechanical properties and which is corrosion resistant. Preferably, AC-AlSi7Mg0, 3ST6 is used for the casting according to the invention. The casting itself is homogeneously structured and stress compatible. In a preferred embodiment, the casting is coated with an elastic surface protection in order to be protected against corrosion-causing influences.

Preferably, the loads and forces of the primary springs above the wheelsets are extensively transmitted and distributed into the bogie frame by means of hat-shaped inserts made of non-corrosive steel. This way, the advantages of the supporting effect in the component are better exploited and point overloads in the support arms are avoided. The protrusion of the insert transmits the stresses via the entire circumference and the entire surface.

Noise and driving noises are significantly reduced by an aluminum casting according to the invention. By choosing a certain type of ribbing inside the cavities, function and stability can be combined efficiently. The ribbings are designed in different shapes and thicknesses according to the calculated stress pattern.

The invention further relates to a process for manufacturing a bogie frame for rail vehicles with at least two wheelsets, two longitudinal members running parallel to each other above the axle bearings and with cross-members connecting the longitudinal members and designed as air reserve reservoirs. Longitudinal members and cross-members can be designed to accommodate functional elements. According to the invention, it is intended that the bogie frame is produced completely as a casting of an aluminum alloy in a sand casting process, said casting having several cavities stabilized by means of ribbings. Preferably, the cavities of the bogie frame are produced by help of sand cores made of chemically bonded sands, said sand cores being stored in the mold. In a preferred embodiment, the cavities of the two longitudinal members and/or the cross-members are formed as air reserve reservoirs. In another preferred embodiment, it is intended that the casting is structured homogeneously and stress-free and that it is preferably coated with an elastic surface protection. A surface protection which does not put thermal stress on the component and a very low level of residual stresses within the component guarantee optimum behavior of the component under operational load conditions. Furthermore, it is preferably intended that in the course of producing the bogie frame, the steel inserts of corrosion-free steel are embedded in the casting mold of the longitudinal members.

The features of the preferred embodiments described here can also be combined with each other. Therefore, the invention also includes combinations of different embodiments, even if these are not described in detail in the examples.

The invention also relates to a rail vehicle which is produced with a bogie frame according to the invention, said bogie frame being produced as a casting made of an aluminum alloy in a sand casting process with a hollow profile.

The invention is explained in more detail in the following drawings.

WAYS OF CARRYING OUT THE INVENTION AND INDUSTRIAL APPLICABILITY

FIG. 1 shows an embodiment of a bogie frame 1 according to the invention as a one-piece component made of cast aluminum. The bogie frame 1 according to the invention can be seen with two longitudinal members 3 arranged parallel to each other. The two longitudinal members 3 are connected to each other by two interconnected cross-members 2. At the same time, the two cross-members 2 are connected to each other by two central longitudinal bridges 4, which comprise a receiving region 5 for functional elements. On each of the two cross-members 2, two opposite lugs 7 are formed as side stops.

The complete component is provided with attachments for functional elements and interfaces, which may protrude from the surface. Due to the stress-flux-compliant form, loads and forces are directed into the interior of the aluminum component in a controlled manner.

Figure 2:
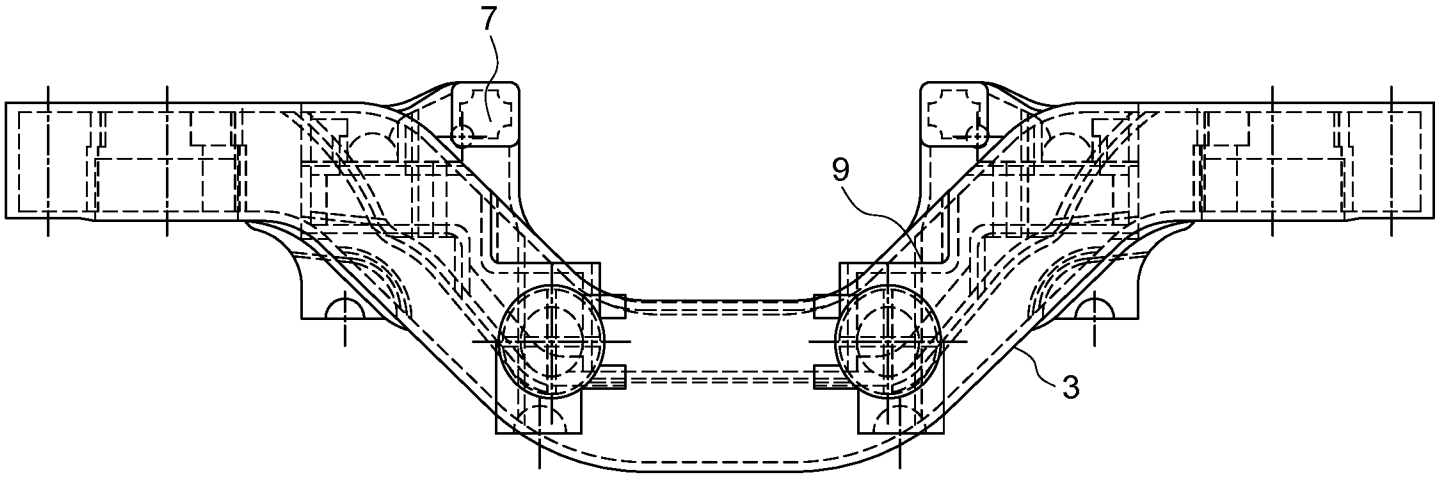
Figure 3:
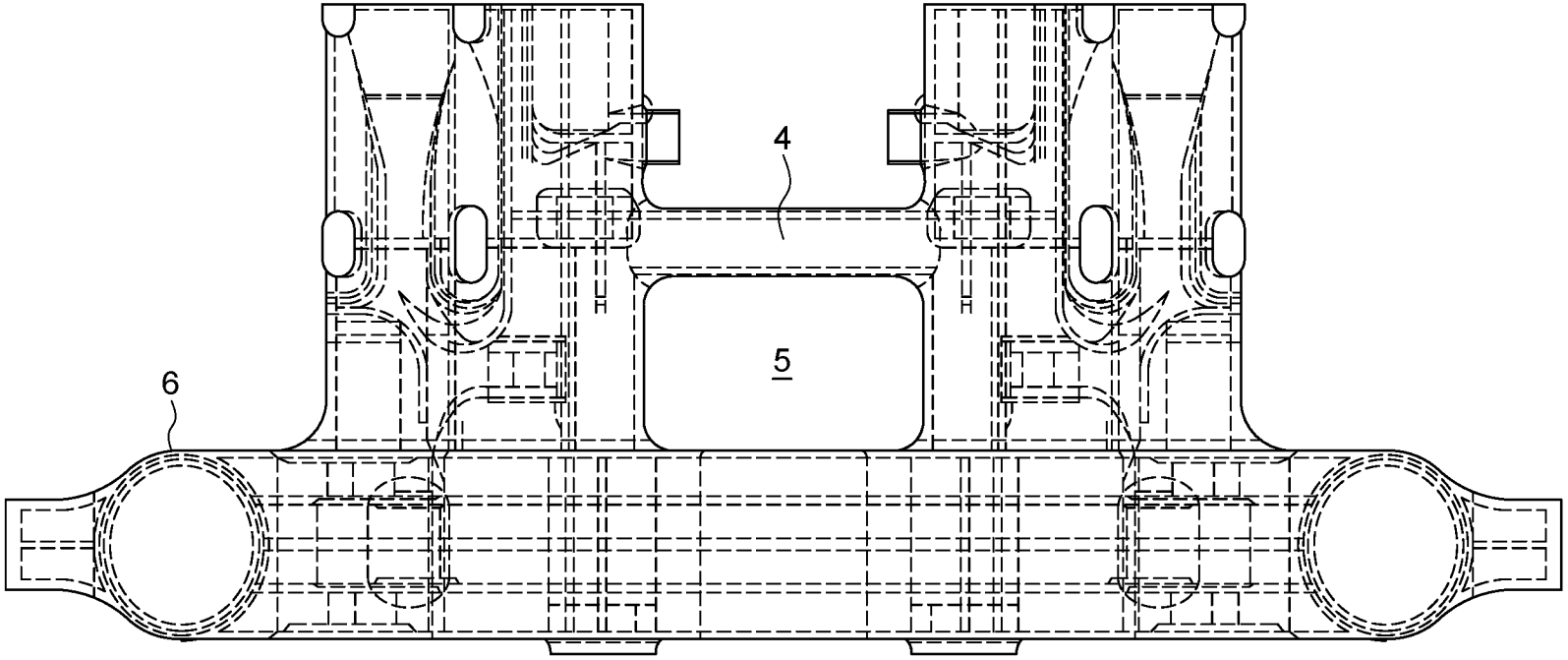
Figure 4:
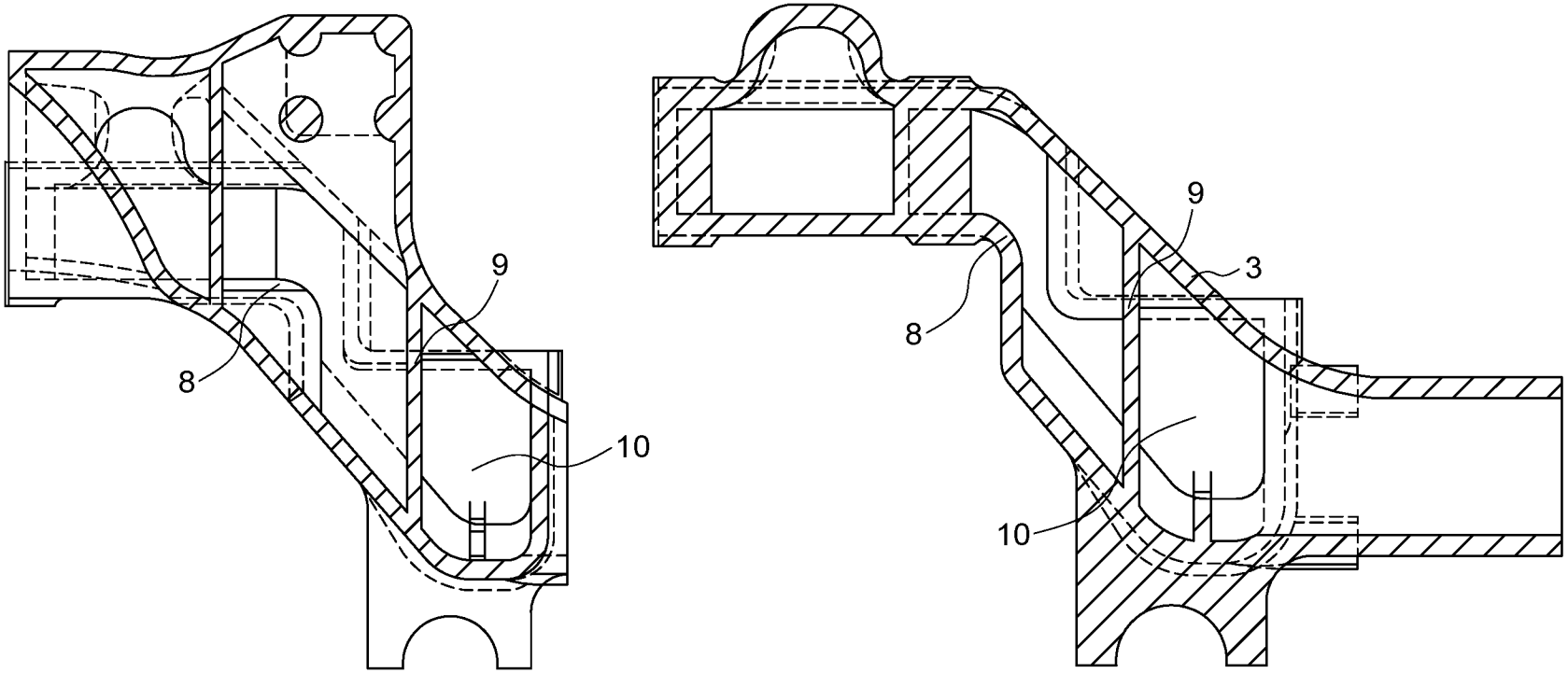

FIGS. 2 to 4 show the hollow profile of the embodiment as shown in FIG. 1. The inside of the casting is hollow and consists of one or more cavities 10, which are separated from each other by ribbings 9. Said ribbings are located at those points which are subject to particularly high stress, and they consist of longitudinal ribs and transverse ribs of various forms. The ribbings 9 stabilize the casting, they distribute the stresses and they take over the supporting function.

In FIG. 2 a side view is shown. It can be seen that the two longitudinal members 3 are connected by two cross-members 2, said cross-members each having two opposite lugs 7 cast on as side stops. The ribbings 9 inside the casting, together with the outer walls 8, take over the structural function of the component.

FIG. 3 shows a top view of a centrally cut component. A receiving region 5 for functional elements as well as the longitudinal bridge 4 can be seen. The steel bushings 6 are embedded in the component (longitudinal beam 3) for the transmission of loads from the primary suspensions. Said primary suspensions are hat-shaped and make use of all contact areas in the component in order to sustainably and evenly transmit the loads into the component.

FIG. 4 shows the individual ribbing 9 of the cavity.

The construction made of an aluminum casting according to the invention, is characterized by substantial cost savings and, simultaneously, by a reduction of weight. Also, driving noises are considerably reduced. Time-consuming welding work on steel components, such as traverses made of ferrous material or air reservoirs made of sheet steel, are not needed anymore. These aspects present considerable advantages compared to previously known bogie frames.

The invention claimed is:

1. A method for producing a bogie frame for rail vehicles with at least two wheelsets, comprising two longitudinal members running parallel to one another via axle bearings, one or more cross-members connected to the longitudinal members and a receiving region for functional elements, characterized in that the bogie frame is produced completely as a casting made of an aluminum alloy in a sand casting process, said casting having a hollow profile, which has cavities in the interior and is stabilized by means of ribbings, wherein the casting is homogeneously formed during the manufacturing process and that the casting is subsequently provided with an elastic surface protection.

2. The method according to claim 1, wherein the cavities are produced from chemically bonded sands.

3. The method according to claim 1 wherein the cavities of the two longitudinal members and/or of a cross-member are formed as required in the form of air reserve reservoirs.

* * * * *